US006945736B2

(12) United States Patent
Smedal et al.

(10) Patent No.: US 6,945,736 B2
(45) Date of Patent: Sep. 20, 2005

(54) OFFSHORE PLATFORM FOR DRILLING AFTER OR PRODUCTION OF HYDROCARBONS

(75) Inventors: Arne Smedal, Færvik (NO); Kåre Syvertsen, Tveit (NO)

(73) Assignee: Sevan Marine AS, Tananger (NO)

( * ) Notice: Subject to any disclaimer, the term of this patent is extended or adjusted under 35 U.S.C. 154(b) by 0 days.

(21) Appl. No.: 10/476,786

(22) PCT Filed: May 8, 2002

(86) PCT No.: PCT/NO02/00170

§ 371 (c)(1),
(2), (4) Date: Dec. 12, 2003

(87) PCT Pub. No.: WO02/090177

PCT Pub. Date: Nov. 14, 2002

(65) Prior Publication Data

US 2004/0156683 A1 Aug. 12, 2004

(30) Foreign Application Priority Data

May 10, 2001 (NO) ..... 20012298

(51) Int. Cl.[7] ..... E02D 29/00; B63B 35/44

(52) U.S. Cl. ..... 405/203; 405/195.1; 405/205; 405/207; 114/264; 114/267

(58) Field of Search ..... 405/195.1, 203–205, 405/207, 210; 114/264, 266, 267

(56) References Cited

U.S. PATENT DOCUMENTS 3,360,810 A * 1/1968 Busking ..... 114/264
3,778,854 A * 12/1973 Chow ..... 441/4
4,473,323 A * 9/1984 Gregory ..... 405/195.1
4,674,918 A * 6/1987 Kalpins ..... 405/224
H611 H * 4/1989 Peace ..... 114/264
4,995,762 A 2/1991 Goldman
5,609,442 A * 3/1997 Horton ..... 405/205
5,722,797 A 3/1998 Horton, III
6,092,483 A * 7/2000 Allen et al. ..... 114/264
6,161,620 A * 12/2000 Cox et al. ..... 166/367
6,179,524 B1 * 1/2001 Allen et al. ..... 405/211
6,309,141 B1 * 10/2001 Cox et al. ..... 405/195.1
6,340,272 B1 * 1/2002 Runge et al. ..... 405/203

FOREIGN PATENT DOCUMENTS

GB 2339730 * 9/2000
WO WO 99 54198 A1 10/1999

* cited by examiner

*Primary Examiner*—Jong-Suk (James) Lee
(74) *Attorney, Agent, or Firm*—Sughrue Mion, PLLC

(57) ABSTRACT

Platform for drilling after or production of hydrocarbons at sea, consisting of a semi-submersible platform body which supports drilling and/or production equipment on its upper surface. The platform body is designed as a vertical mainly flat bottomed cylinder which is provided with at least one peripheral circular cut-out in the lower section of the cylinder since the centre of buoyancy for the submerged section of the platform is positioned lower than the centre of gravity of the platform.

10 Claims, 4 Drawing Sheets

OFFSHORE PLATFORM FOR DRILLING AFTER OR PRODUCTION OF HYDROCARBONS

BACKGROUND OF THE INVENTION

The present invention relates to a platform for drilling after or production of hydrocarbons at sea, consisting of a semi-submergible platform which supports drilling and/or production equipment on its upper surface.

Drilling after or production of hydrocarbons (oil and gas) by use of floating units is to date dominated by two different types of units, namely vessel or semi-submersible platform.

Units which are based on vessels are recognised by large dead weight measurement with regards to production or drilling equipment, and large storing capacity for oil, fuel etc. Disadvantages with units of this type are dependency to direction of environmental forces like wind, current and waves. When environmental forces act across a vessel the forces and the movement of the vessel often become large. To reduce the forces and the movement of an anchored vessel a turret (rotational body) is often used for the vessel to turn about. For production on vessels this leads to high costs and it complicates transfer from risers which runs from the seabed (due to requirements to the swivel transfer etc).

Units which are based on semi-submersible platforms are recognised by small movements and independency with regards to the direction of environmental forces. The units can simply be anchored by the use of a fixed anchoring system and risers can be connected directly to the receiving system on the platform. Disadvantages with a known solution of this type is small dead weight measurement on deck and little storage capacity for oil, fuel etc.

Other units which recently have been introduced for floating production are the so called "spar" buoys. These units consist of a cylindrical hull with buoyancy in the upper part and ballast in the lower part. The height (and the depth) is considerable larger than the units largest diameter. A similar concept with a large submerged cylinder construction and a small diameter in the water surface has also been suggested. Both these solutions and also a suggestion of a conical submerged part, is recognised by that stability is achieved by the centre of gravity being lower than the centre of buoyancy (as for a submerged bottle). Units based on simplified hulls, such as a square or octagon, submerged box-construction, have also been suggested as possible solutions.

Reduced movements are of great importance both for units which are used for drilling and for units which are used for production. When drilling there are small tolerances to rolling and pitching movements. Typical marginal values for operations are in the region of 2 to 4 degrees. For production Units the process equipment is sensitive for movements. The efficiency of the equipment being used today is reduced with rolling or pitching angles above 2 to 4 degrees. It is therefore very important to get a reduction especially of rolling and pitching movements to get an efficient unit for drilling after or production of oil and gas.

SUMMARY OF THE INVENTION

Thus the main objective with the present invention is to provide an offshore platform which is constructed with an eye to achieve a reduced rolling and pitching movement and also reduced heave motion.

Another objective with the invention is to provide such a platform which will combine the positive characteristics by units based on vessels and units based on semi-submergible platforms.

An additional objective with the present invention is to provide a platform which has a simple construction and low building costs since the platform can be built at a standard equipped shipyard and can be constructed and built in principle as a ship.

To achieve the objectives mentioned above it is provided a platform of the type given above which according to the invention is characterised by that the platform body is designed as a vertical, mainly flat bottom cylinder which is supplied with at least one peripheral circular cut-out in the lower part of the cylinder, since the centre of buoyancy to the submerged part of the platform is positioned lower than the centre gravity of the platform.

By designing the cylindrical platform in this way, with at least one cut-out along the circumference or a groove which appropriately has by and large horizontal upper and lower sidewalls, a considerable reduction in pitching and rolling movement will be achieved. These favourable results are achieved as a result of physical conditions which will be described in more detail below.

The behaviour of the platform with regards to rolling or pitching movements is related to the same forces as those giving rolling movements for a ship. When a wave comes rolling towards the side of a vessel, the wave swell and the pressure ratio downwards in the wave will give a vertical force upwards where the wave increase and accordingly a reduced force of pressure where the wave goes below the medium level. These forces give a rolling moment to the ship. Accordingly they will give a rolling movement (or pitching movement) on the presented, cylindrical platform.

In addition to the pressure variations in the water under a wave it is also particle movements. The water particles move in an elliptical movement which give both accelerations and speed which varies over a wave period. The cut-out and the annular section of the cylindrical body underneath the cut-out will disturb the particle stream in the wave. The edges above and below the cut-out will create large whirls in the water which runs by. The energy which is needed to create the whirls, represents forces which act on the construction. A similar effect arises at the sharp edge between the bottom of the cylinder body and its vertical side. In addition will the annular shaped body underneath the cut-out give a certain flow resistance. The collected forces from the creation of the whirls and the flow resistance will give forces which have a vertical component which act in the opposite direction to the buoyancy forces from the wave swell. Tests have shown that by an appropriate design of the cut-out or the cut-outs and the annular body thereof, the forces which give rolling or pitching movement will be greatly reduced.

In addition to the above-mentioned favourable effect will this platform design bring a lot of other advantages.

Thus a cylindrical platform will have large dead weight measurement with regards to production or drilling equipment and large storage capacity for oil, fuel etc. The platform will be independent with regards to the direction of environmental forces and it can be anchored with a simple, fixed anchoring system. Further the risers can be connected directly to a receiving system on the platform without the need for swivel transfer or similar.

The platform can be built at a normally equipped shipyard and can be constructed and built in principle as a ship. In addition it will be possible to efficiently isolate the different main units on the platform form each other. The lower section of the platform will mainly consist of tanks for oil, ballast, fuel, possible drilling liquid etc. On the upper deck of the platform there will be necessary installations, such as living quarters, machinery and power supply, process equipment and possibly drilling equipment, to be arranged in separated areas. The circular (polygon) form of the cylinder body will give short distances between different types of equipment. This will reduce the length and the extent of pipe and cable systems and will contribute to give a cost effective platform.

The design of the platform gives the opportunity to build in a high degree of safety with regards to accidents, such as collisions or explosions. The platform will be built with double sidewalls and double bottom (ballast tanks) as in a ship. This will give high degree of safety at any accidents and reduces the danger for serious consequences.

BRIEF DESCRIPTION OF THE DRAWINGS

The present invention will be described in more detail in the following in connection with design examples with reference to the drawings, where FIG. 1(*a*) shows a partly cut through side section of a first design of a the platform according to the invention.

On the different drawings respective parts and elements are marked with the same reference numbers.

DESCRIPTION OF THE EXEMPLARY EMBODIMENTS

Figure 1A:
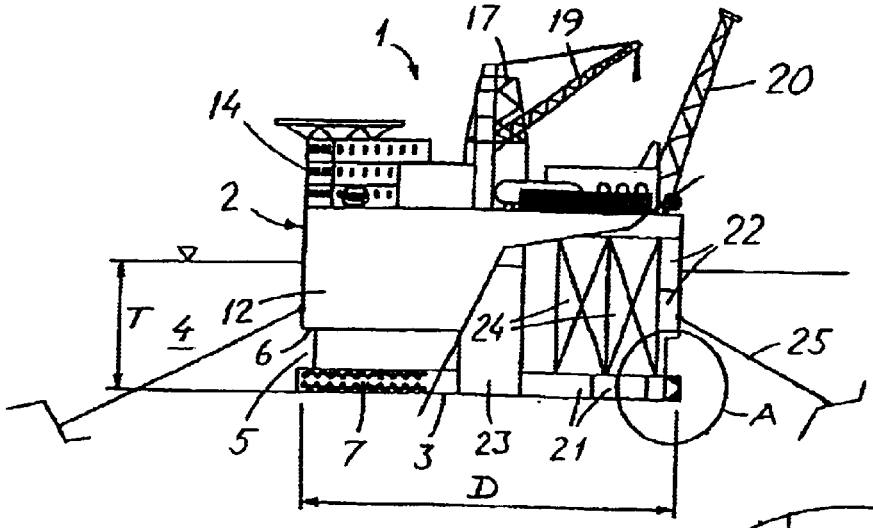
Figure 1B:
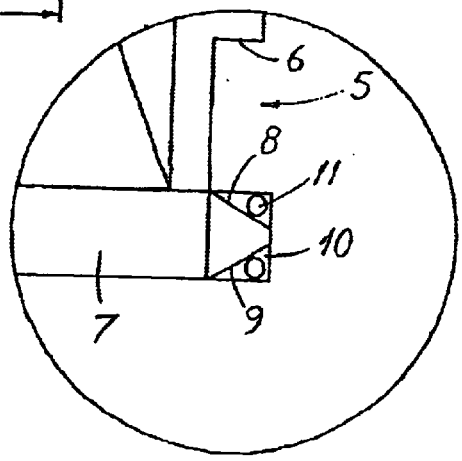

FIGS. 1(*a*) and 2 show a platform 1 consisting of a semi-submersible platform body or hull 2 which is designed as a vertical cylinder with a flat bottom 3. The platform is floating in the water 4. The lower half of the cylinder is supplied with a peripheral groove or cut-out 5 which runs along the whole circumference of the cylinder. In the shown design the cut-out 5 is at its upper edge limited by and large a horizontal sidewall 6, while it by its lower edge is limited by an annular body 7 which is designed with the view of achieving an extra dampening effect on the movement of the platform.

As shown in the enlarged detail A of FIG. 1(*a*), shown as FIG. 1(*b*), the annular body 7 has outwards converging upper and underside which can be formed by, annular plates 8 and 9 which is fixed at the lower end of the cylinder body 2. At the outer edge of the plates 8, 9 it is fixed by and large a vertical annular perforated plate 10 with a large number of wholes 11. The plates 8, 9 form deflecting plates for water which runs along the side of the cylinder body 2, so part of the flow of water changes direction and are being forced through the perforated plate 10. This lead to further dampening of the movement of the platform.

The shown dampening arrangement can be varied in different ways, for example with regards to the width of the plate 10 and its distance from the cylinder body 2. The latter distance is dependent on the width and the inclination of the plates 8 and 9. The plates 8, 9 can possibly be curved as concave deflecting plates or be combined or replaced with one horizontal plate.

A similar dampening arrangement can possibly be arranged with the upper edge of the cut-out 5.

Figure 8:
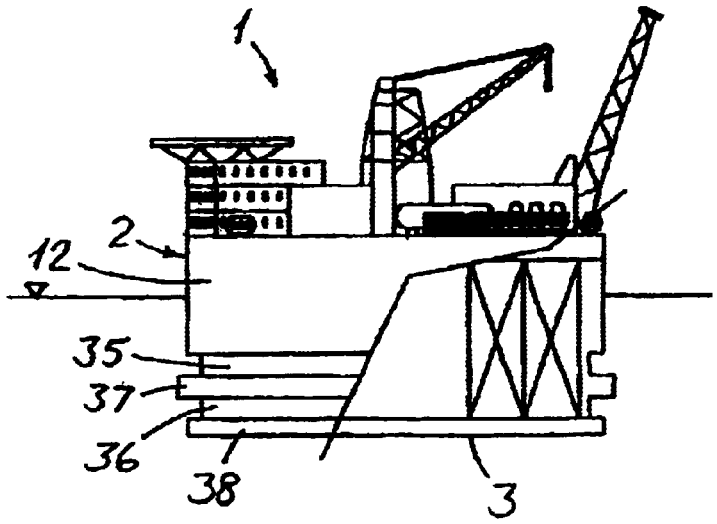

In the design of FIG. 1(*a*), the annular body 7 has an outer diameter which is by and large similar to the diameter of the cylindrical part 12 of the cylinder body 2 above the cut-out. Further it is only arranged one cut-out. However, there may be arranged more than one cut-out and then possibly with different diameters of the cut-out limited annular section of the cylinder body, i.e. as shown in FIG. 8.

Figure 2:
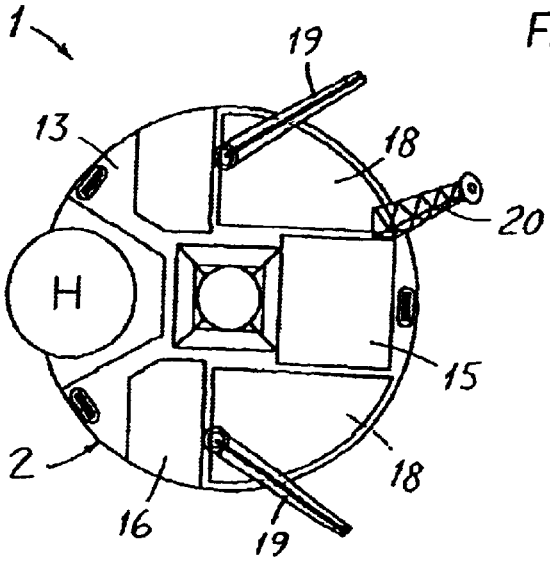
FIG. 2 shows a layout of the platform of FIG. 1(*a*)
Figure 4:
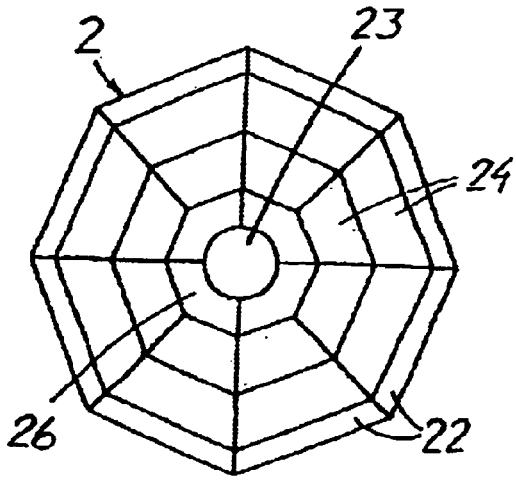

In the shown design the platform body 2 has a circular cylindrical cross-section as can be seen from FIG. 2. The cylinder can at any rate have a polygon cross-section as shown in FIG. 4.

The diameter D of the platform body will normally be larger than its depth T of the draught. Further the centre of buoyancy for the submerged part of the platform will be lower than the centre of gravity of the platform as for a ship.

The platform is thought to be built of steel preferably, with build up of elements of strength as for a ship. Other materials like concrete, can also be used.

The platform has an upper deck 13 which sports different installations on the deck which are necessary for a platform of the present type. As an example it is on the drawing for one shown a living quarter 14 with a helicopter deck "H" on the top, a machine room 15, a workshop/storage 16, drilling equipment 17, process/storage area 18, two cranes 19 and a flare tower 20.

As shown on FIG. 1(*a*), the platform body 2 is supplied with a double bottom and with double sidewalls, with the view to reduce the extent of damage in a possible collision or explosion on the platform. The space which is limited by the double bottom and sidewalls, is divided in a number of ballast tanks 21 (in the bottom) and 22 (in the sidewalls).

In the centre of the cylinder body 2 it is arranged a vertical, through shaft or so called "moonpool" 23, for receiving of risers or other equipment which is used in oil production or drilling.

Further it is arranged a number of tanks 24 in the platform body, in a similar way as for a ship. These tanks can be used for storage of oil, for ballast or for storing of fuel or possibly drilling liquid which is used in drilling.

In the design on FIG. 1 the platform 1 is anchored by the use of a number of anchor lines 25. Alternatively the platform can be kept in position by the use of dynamic positioning, since it is supplied with an active thrusters system (not shown) for this purpose.

Figure 3:
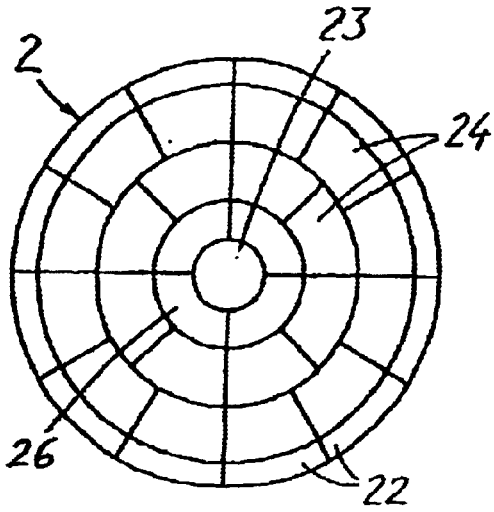
FIGS. 3 and 4 show a cross-section of a cylindrical and a polygon platform body respectively where the body is supplied with a central vertical shaft.
Figure 5:
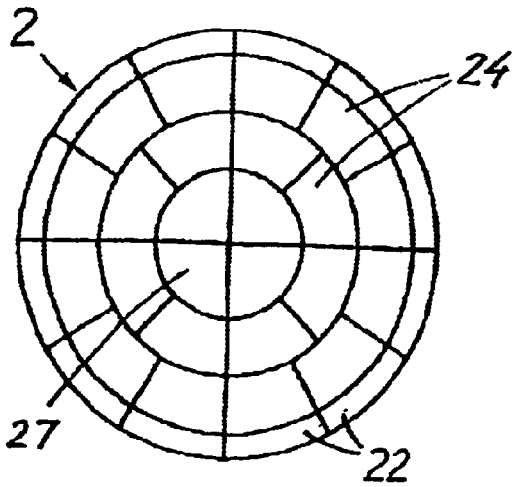
FIG. 5 shows a cross-section of a circular cylindrical platform body without a central shaft.

FIGS. 3–5 show examples of possible tank arrangements. On the inside of the ballast tanks 22 in the double sidewalls, the platform body 2 is shown to be sectioned into two annular tank sections of which is split in a number of tank 24. In the design on FIGS. 3 and 4 the platform or cylinder body consist of the centre shaft 23 and this is surrounded of an annular room 26 for access and for installation of pipes, pumps etc. The design of FIG. 5 is without a central shaft and the central part of the cylinder body is here split in four rooms or tanks 27.

Figure 6:
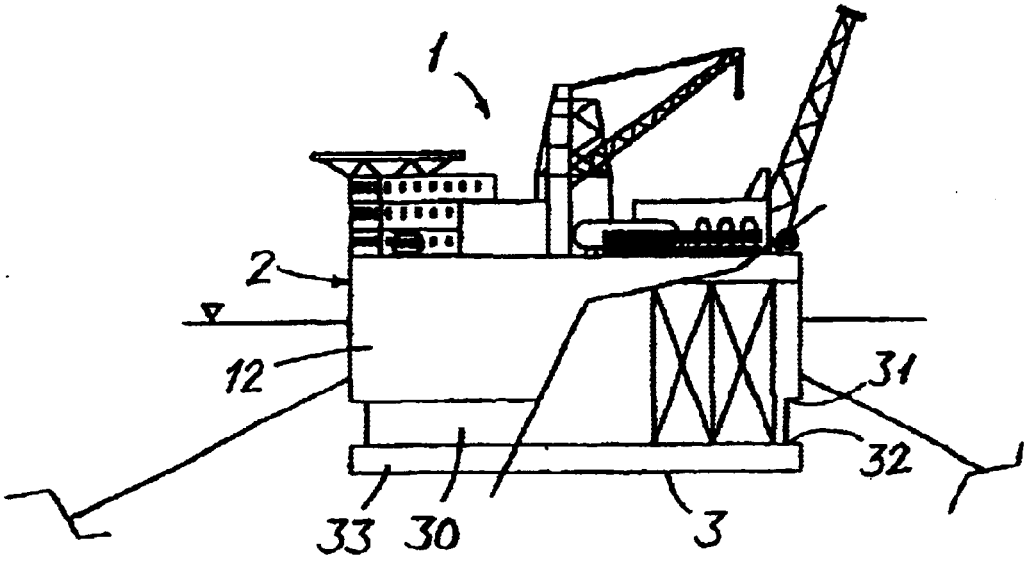
FIG. 6 is a partly cut-through side-view of a platform design which is without a central vertical shaft.
Figure 7:
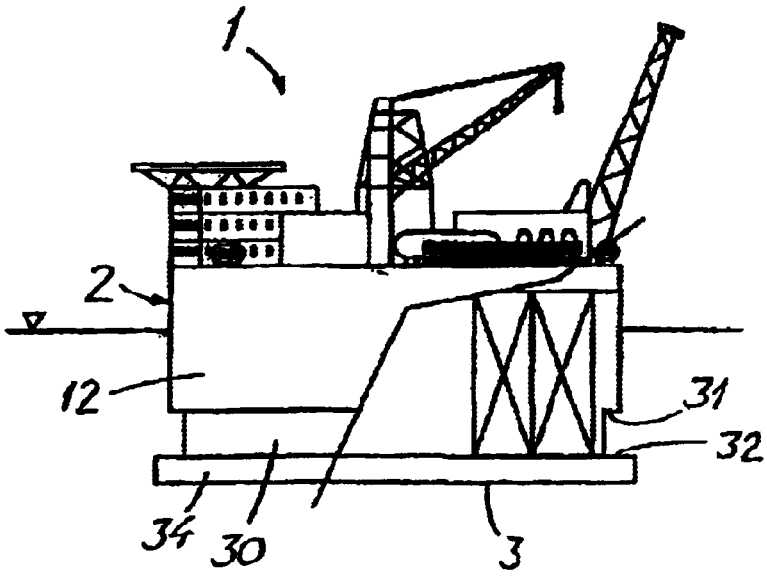
FIGS. 7 and 8 show a similar side-view as FIG. 1(*a*) of platforms with alternative design of the cut-out arrangements and FIG. 9 shows a similar side-view as to FIG. 1(*a*) where the platform is supplied with a drilling tower.

FIGS. 6–8 show different designs of the damping arrangement of the platform In the design of FIG. 6 a cylindrical body 2 is supplied with a peripheral cut-out 30 which is limited at its upper and lower edges by and large the horizontal upper and lower sidewall 31 and 32. Annular body 33 under the cut-out 30 has in hiss case the same diameter as the cylindrical part 12 of the platform body 2 above the cut-out.

The design of FIG. 7 is similar to the design of FIG. 6 except that the annular body 34 underneath the cut-out 30 has larger diameter than the cylindrical section 12 above the cut-out.

FIG. 8 shows a design where the platform body 2 is supplied with two peripheral cut-outs 35 and 36 with an intermediate annular section 37. Both cut-outs 35, 36 are shown to be limited mainly by horizontal upper and lower sidewalls. The annular body 38 underneath the lower cut-out 36 has in this case the same diameter as the cylindrical part 12 of the platform body 2 above the cut-outs, while the section 37 is shown to have a larger diameter. The annular body 38 can however have the same diameter as the section 37, or possibly have a larger diameter than this section.

As it can be seen from FIGS. 6–8, the platform design is according to these figures not supplied with a central vertical shaft.

Figure 9:
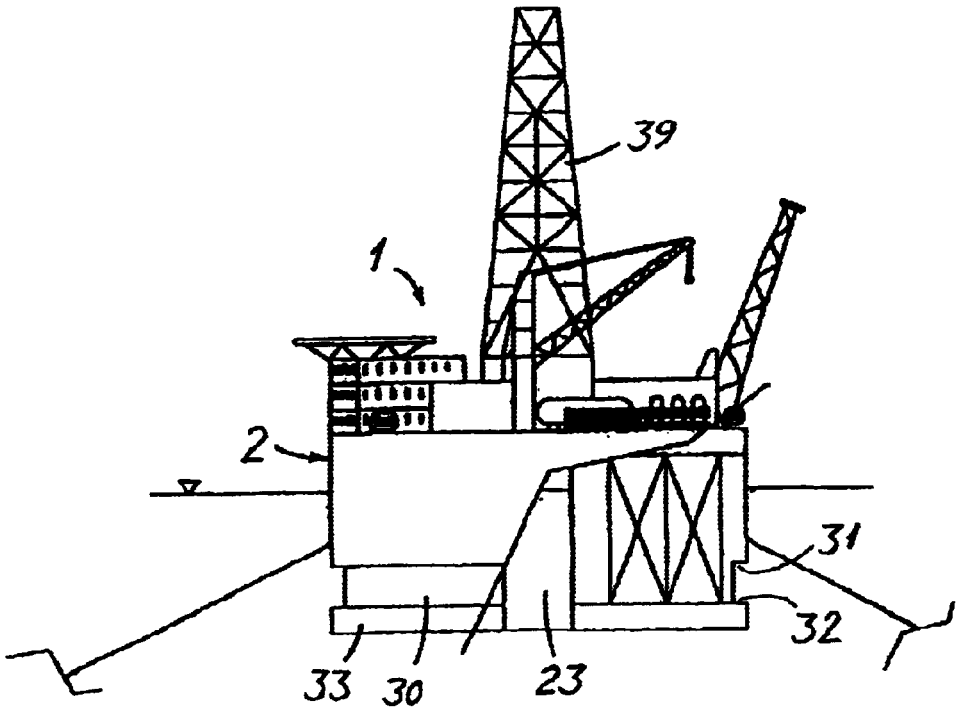

FIG. 9 shows a platform design which corresponds to the design of FIG. 6 with regards to damping arrangement, but where the platform is supplied with a central, vertical shaft 23 and where the drilling tower 39 is arranged on the platform deck above the shaft.

What is claimed is:

1. A platform for drilling after or production of hydrocarbons at sea, comprising a semi-submersible platform body which supports drilling and/or production equipment on its upper surface, the platform body being formed as a vertical essentially flat-bottomed cylinder, characterized in that the platform body in the lower part of the cylinder is provided with at least one peripherally encircling recess which is delimited by a ring body below the recess, and that the diameter of the cylindrical part of the platform body is substantially larger than the depth of its draught, and the centre of buoyancy of the submerged part of the platform is located lower than the centre of gravity of the platform.

2. A platform according to claim 1, characterized in that the platform body has a circular cross-section.

3. A platform according to claim 1, characterized in that the platform body has a polygonal cross-section.

4. A platform according to claim 1, characterized in that the ring body has upper and lower sides formed by outwardly converging surfaces, an essentially vertical, annular perforated plate being fastened to the outer edge of the ring body.

5. A platform according to claim 1, characterized in that the recess or recesses at their upper and lower edges are delimited by essentially horizontal, upper and lower sidewalls.

6. A platform according to claim 5, characterized in that the cylindrical portion below the recess has a diameter which is larger than the diameter of the platform body above the recess.

7. A platform according to claim 5, characterized in that the platform body is provided with several peripheral recesses, where the annular portions delimiting the recesses have different diameters.

8. A platform according to claim 1, characterized in that the platform body is provided with a central vertical shaft for receiving risers or other drilling or production equipment.

9. A platform according to claim 1, characterized in that the platform body includes a number of tank sections comprising tanks for storage of oil, ballast or other liquids.

10. A platform according to claim 1, characterized in that the platform body is provided with a double bottom and with double sidewalls, the spaces defined by the double bottom and the sidewalls being divided into a number of ballast tanks.

* * * * *